US011578505B2

(12) United States Patent
Litwinski

(10) Patent No.: US 11,578,505 B2
(45) Date of Patent: Feb. 14, 2023

(54) DRIVING DEVICE FOR UNLOCKING AND LOCKING A LOCK

(71) Applicant: Artur Litwinski, Warsaw (PL)

(72) Inventor: Artur Litwinski, Warsaw (PL)

( * ) Notice: Subject to any disclaimer, the term of this patent is extended or adjusted under 35 U.S.C. 154(b) by 473 days.

(21) Appl. No.: 16/617,225

(22) PCT Filed: May 29, 2018

(86) PCT No.: PCT/IB2018/053802

§ 371 (c)(1),
(2) Date: Nov. 26, 2019

(87) PCT Pub. No.: WO2018/220522

PCT Pub. Date: Dec. 6, 2018

(65) Prior Publication Data

US 2020/0149319 A1 May 14, 2020

(30) Foreign Application Priority Data

May 31, 2017 (PL) ..... 20170421765
May 31, 2017 (PL) ..... 20170421766

(51) Int. Cl.
*E05B 47/00* (2006.01)
*E05B 47/06* (2006.01)
*G07C 9/00* (2020.01)

(52) U.S. Cl.
CPC ..... *E05B 47/0012* (2013.01); *E05B 47/0615* (2013.01); *G07C 9/00182* (2013.01);
(Continued)

(58) Field of Classification Search
CPC ..... Y10T 70/5805; Y10T 70/7062; Y10T 70/7102; Y10T 70/7107; E05B 47/0012;
(Continued)

(56) References Cited

U.S. PATENT DOCUMENTS 6,418,764 B1 * 7/2002 Lerchner ..... E05B 47/068 70/279.1
7,516,633 B1 4/2009 Chang
(Continued)

FOREIGN PATENT DOCUMENTS

DE 202016002087 U1 5/2016
EP 0542944 5/1993
(Continued)

OTHER PUBLICATIONS

International Search Report in PCT/DE2018/053802 dated Dec. 9, 2018.
(Continued)

*Primary Examiner* — Lloyd A Gall
(74) *Attorney, Agent, or Firm* — Ralph E. Jocke; Walker & Jocke

(57) ABSTRACT

Apparatus for unlocking and locking a lock (1') enabling access to protected areas. The apparatus comprises a housing (5) with a housing interior (64). A rotational shaft (30) is in operative connection with the housing. A motor (10) extends in the housing interior (64), is in operative rotational connection with shaft (30) and is operative to rotate the shaft (30). A battery cell (9) extends in the housing interior (64) and is in partially surrounding relation of the motor (10). The battery cell is in operative electrical connection with the motor (10). In cross section, the battery cell (9) includes at least two points (34) and (36) such that a line segment (32) joining these two points passes through the motor (10).

21 Claims, 18 Drawing Sheets

(52) U.S. Cl.
CPC . *E05B 2047/002* (2013.01); *E05B 2047/0058* (2013.01); *E05B 2047/0067* (2013.01); *E05B 2047/0095* (2013.01); *G07C 2009/0019* (2013.01)

(58) Field of Classification Search
CPC ..... E05B 47/0615; E05B 2047/002; E05B 2047/0058; E05B 2047/0067; E05B 2047/0095; E05B 2047/0091; G07C 9/00182; G07C 2009/0019
See application file for complete search history.

(56) References Cited

U.S. PATENT DOCUMENTS

| | | | | |
|---|---|---|---|---|
| 2014/0260451 | A1 | 9/2014 | Quach et al. | |
| 2015/0096341 | A1* | 4/2015 | Overgaard | E05B 47/02 70/283.1 |
| 2015/0102609 | A1 | 4/2015 | Johnson et al. | |
| 2020/0115926 | A1* | 4/2020 | Tan | E05B 47/0611 |
| 2020/0173195 | A1* | 6/2020 | Litwinski | E05B 47/02 |

FOREIGN PATENT DOCUMENTS

| | | | |
|---|---|---|---|
| EP | 2 365 475 | A1 | 9/2011 |
| WO | WO2015166502 | A1 | 4/2015 |
| WO | WO 2015/138747 | A1 | 9/2015 |
| WO | WO2016196192 | A1 | 12/2016 |
| WO | WO 2017/046399 | A1 | 3/2017 |

OTHER PUBLICATIONS

Written Opinion of International Search Authority in PCT/DE2018/053802.
Non-Final Office Action In U.S. Appl. No. 16/617,299 dated Mar. 11, 2022.

* cited by examiner

DRIVING DEVICE FOR UNLOCKING AND LOCKING A LOCK

TECHNICAL FIELD

The exemplary embodiments concern a driving device for unlocking and locking a lock enabling access to protected areas, and in particular the device relates to the so called "intelligent locks", the unlocking or locking of which may be effected without an authorized person directly contacting the lock. Some exemplary embodiments concern an apparatus operative to selectively rotationally position a dog of lock to change the lock between a locked condition and an unlocked condition.

BACKGROUND

From Polish application P.336314 a driving device for a lock is known. The driving device, fixed on the door as a plate fitting, for the motor-driven and manual actuation of a locking cylinder, has a drive shaft for transmitting rotation to the locking cylinder, a turning knob for manually turning the drive shaft and a gear motor, arranged in the turning knob, for the motor-driven rotation of the drive shaft. A driving toothed wheel is seated on the drive shaft in a non-rotating manner and is connected with the turning knob such that it transmits torque. The gear motor is coupled to the plate fitting in a non-rotating manner and it becomes coupled to the driving toothed wheel by means of a coupling when current is applied.

From German patent application DE102014009826A1 a device for unlocking and locking entrances to access-protected areas is known. The device has a cylindrical housing. The housing holds a base plate, a miniature motor, preferably a direct current motor, an electric battery, a blocking assembly and a control unit. The blocking element of the blocking assembly is a rod with a ring, moved by the electric motor via a torsion spring arranged to transmit motion from the motor to the rod. The electric battery is to provide power supply to the control system irrespective of power supply for the device via an external power supply line. The control unit is controlled via a wireless connection.

Driving devices for changing the condition of a lock may benefit from improvements.

DISCUSSION

The objective of some exemplary embodiments is to develop a new driving device for unlocking and locking a lock, the driving device being of simple design and with low overall dimensions, and to provide a new solution type.

According to some exemplary embodiments, the driving device for unlocking and locking a lock enabling access to protected areas, within its housing comprises: a gear assembly, at least one electric energy source in a protective housing and an electric driving motor transmitting drive to a rotary control element for the lock mechanism by means of the gear assembly. The exemplary lock has a body, in which the control element is seated rotatably. The device, in exemplary embodiments, includes an individual electric energy source that is so shaped that with its shape, in the cross-section through the driving motor and the electric energy source, it at least partially surrounds the driving motor, which means that in the area of the cross-section through the electric energy source, in some exemplary embodiments, there are at least two points such that a line segment joining these points passes through the area of the cross-section of the driving motor.

Such shaped electric energy source so arranged around the driving motor makes it possible to considerably reduce the overall dimensions of the device by significant elimination of cavities within the housing.

In some exemplary embodiments, the driving device is fitted with a base, fixed with respect to the lock, with the gear assembly, the at least one electric energy source and the driving motor being seated fixedly with respect to the base.

In some exemplary embodiments, the control element for the lock mechanism is seated on a toothed wheel, the toothed wheel being one of the wheels of the gear assembly, and the housing is in a form of a bushing seated in a bearing in the base and it has, from the inner side, teeth engaging with the toothed wheel of the gear assembly, on which the control element for the lock mechanism is seated.

In some exemplary embodiments, the housing is seated in a bearing rotatable with respect to the body of the lock and is connected fixedly with the rotary control element for the lock, and the gear assembly, the at least one electric energy source and the driving motor are seated fixedly with respect to the housing and they rotate together with the housing, with the driving device being fitted with a ring with teeth, the ring cooperating with the toothed wheel, the toothed wheel being one of the wheels of the gear assembly and seated in a bearing in the housing, with the ring being positioned coaxially with the rotary housing and fixedly with respect to the body of the lock.

In some exemplary embodiments, the teeth of the ring are inner or outer teeth.

In some exemplary embodiments, the ring is arranged between the gear assembly and the lock.

In some exemplary embodiments, the housing is connected with the control element by means of a shaped releasable connection.

In some exemplary embodiments, the housing is fitted with an electric socket. In some exemplary embodiments, the electric socket comprises a micro USB type socket, configured to charge the electric energy source.

In some exemplary embodiments, the protective housing of the electric energy source has a battery opening, in which the driving motor is arranged.

In some exemplary embodiments, the protective housing of the electric energy source is cross-sectionally wheel-shaped, with the hole positioned coaxially.

In some alternative exemplary embodiments, the protective housing of the electric energy source is cross-sectionally wheel-shaped, with the opening positioned eccentrically.

In some exemplary embodiments, the protective housing of the electric energy source has a cavity, in which the driving motor is arranged.

In some exemplary embodiments, the shape of the cavity in cross-section is a segment of a wheel.

In some exemplary embodiments, the protective housing of the electric energy source is a segment of a ring, the axis of which is parallel to the axis of the driving motor.

In some exemplary embodiments, the electric energy source is either a primary electric cell or a secondary electric cell.

In some exemplary embodiments, the electric energy source is fitted with an anode, cathode and separator, all spirally wound in the form of a band around the through hole.

In some alternative exemplary embodiments, the electric energy is fitted with an anode, cathode and separator, all arranged in layers, the plane of which is perpendicular to the axis of the driving motor.

In some alternative exemplary embodiments, the electric energy source is fitted with an anode, cathode and separator, all arranged in layers being sectors of cylindrical surfaces of an axis parallel to the axis of the driving motor.

In some exemplary embodiments, the gear assembly comprises a coupling.

In some exemplary embodiments, the driving device is fitted with an electronic control unit to control the driving motor and preferably fitted with a first sensor cooperating with a manual control button, arranged on the frontal part of the driving device.

In some exemplary embodiments, the electronic control unit is fitted with a second sensor which determines the angular position of the rotary control element for the lock mechanism, the second sensor preferably being an accelerometer (gravitational field sensor).

In some exemplary embodiments, the electronic control unit is controlled wirelessly, preferably by means of computer software, preferably a mobile device application, via a wireless connection.

DETAILED DESCRIPTION

Figure 1:
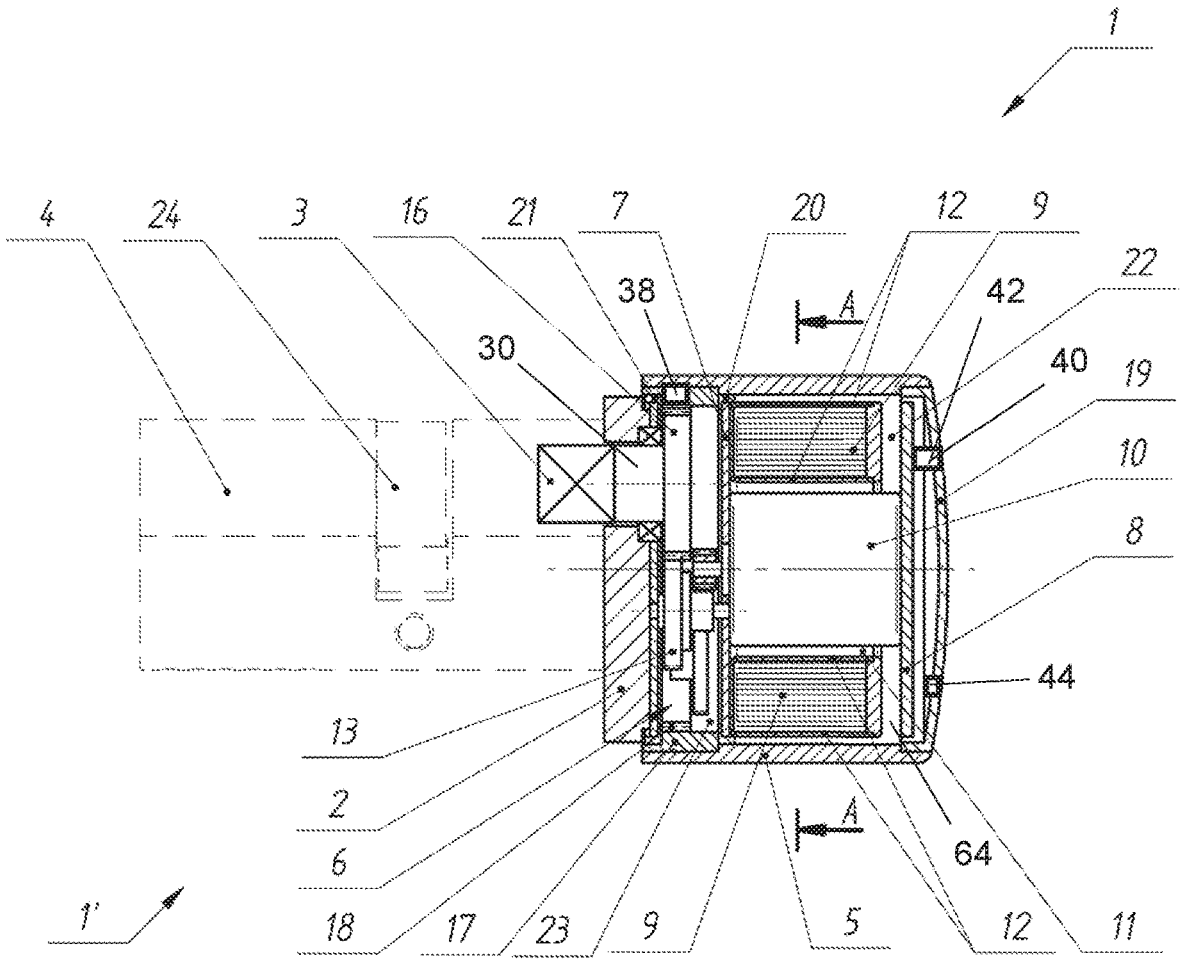
FIG. 1 shows a longitudinal cross-section of an exemplary driving device for unlocking and locking a lock, having a housing in the form of a bushing, in which a ring with teeth is seated.
Figure 1A:
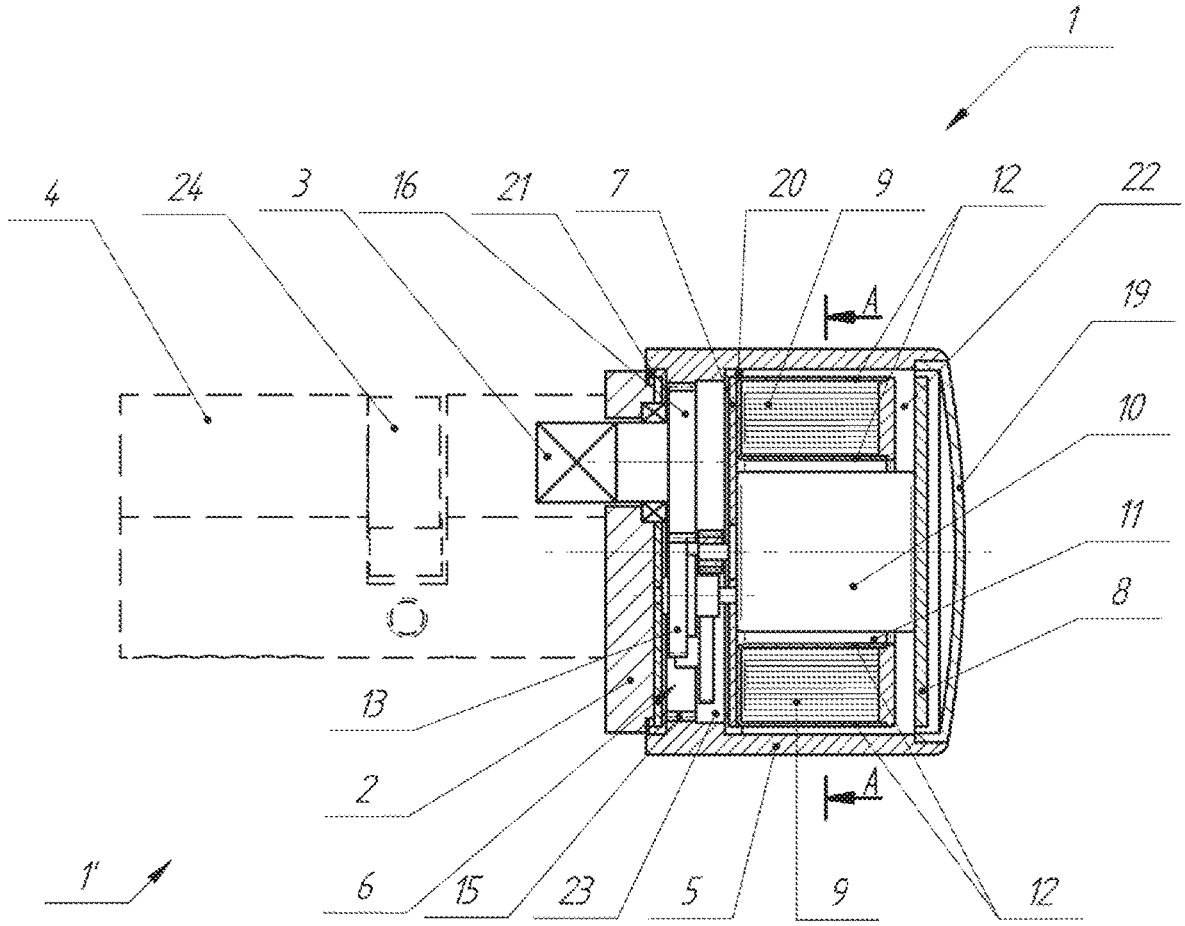
FIG. 1*a* shows the exemplary driving device for unlocking and locking a lock, having the housing in the form of a bushing having teeth from the inner side.
Figure 2:
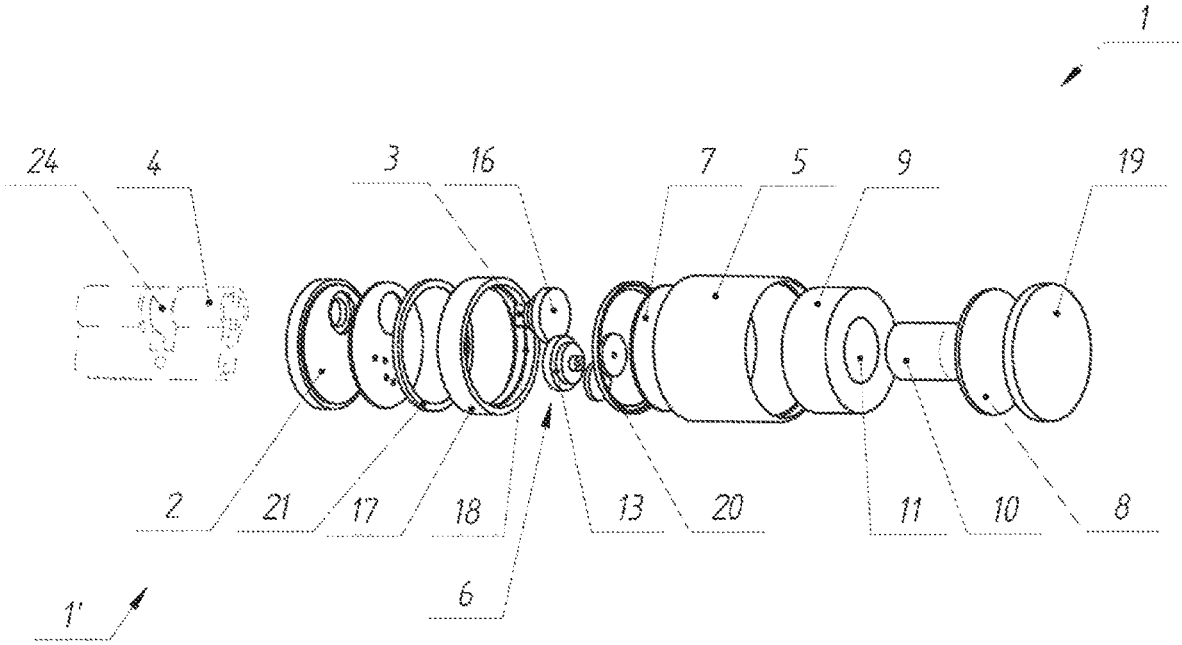
FIG. 2 shows an exploded perspective view of the exemplary driving device of FIG. 1.
Figure 3:
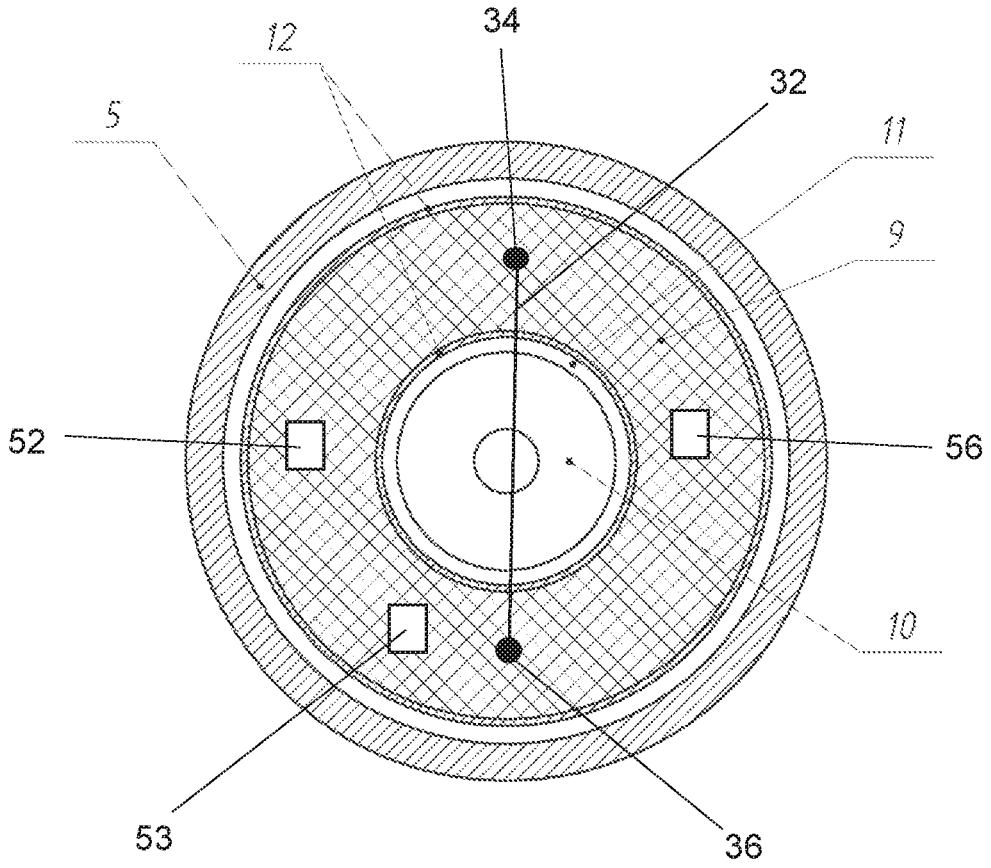
FIG. 3 shows an A-A cross section of FIG. 1.
Figure 3A:
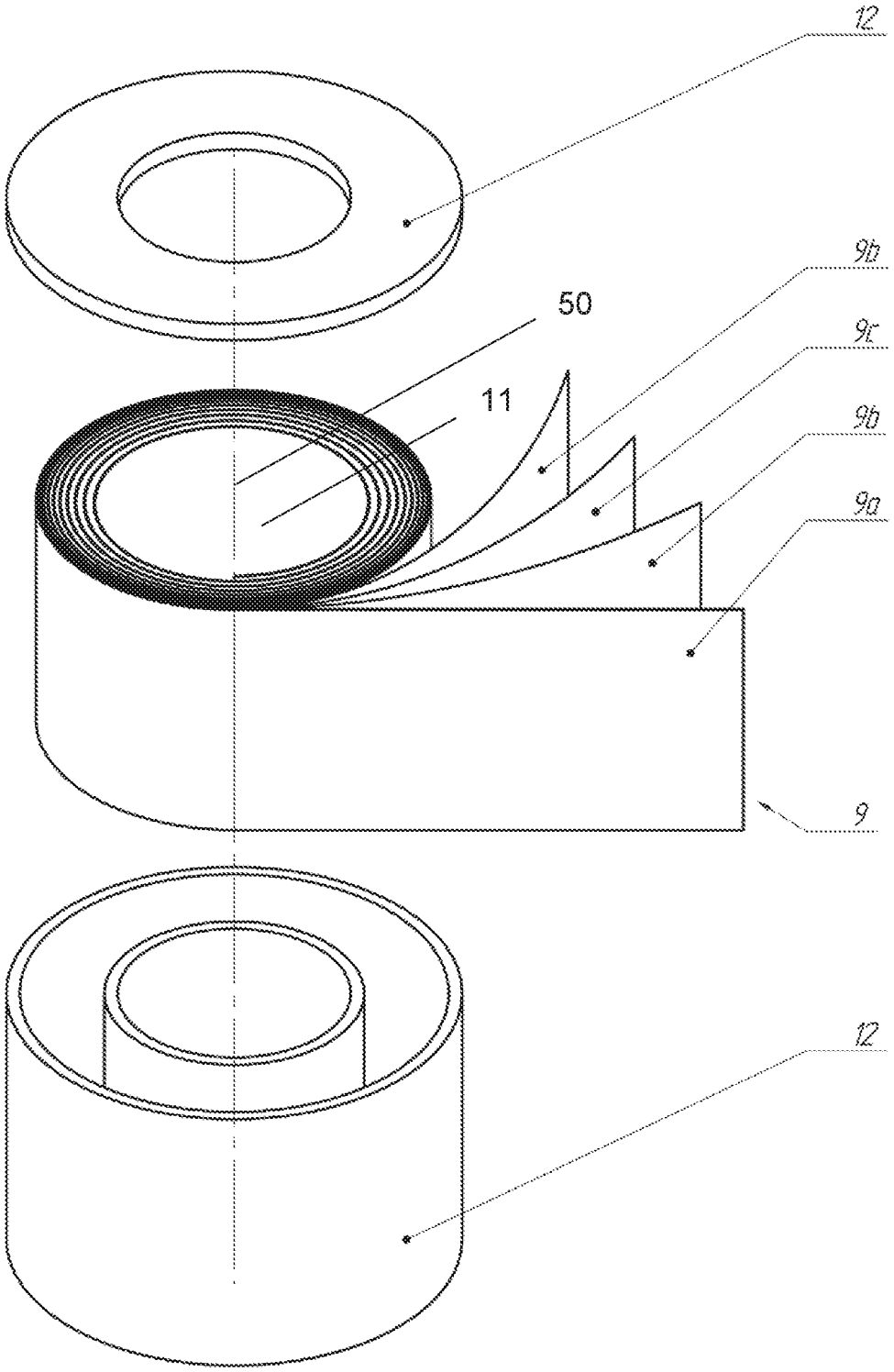
FIG. 3*a* shows an exemplary construction of the electric battery cell being the electric energy source.

As shown in the exemplary embodiments in FIG. 1, FIG. 2 and FIG. 1*a*, an exemplary driving device 1 for unlocking and locking a lock 1' enabling access to protected areas has a cylindrical housing 5. The exemplary housing is made in a form of a bushing covered at the front with a cover 19. The housing includes a housing interior 64. The exemplary driving device 1 comprises a single electric energy source 9, also referred to as a battery cell, having a form of a cylinder with a coaxially positioned battery opening 11. The exemplary electric energy source 9 is fitted with an anode 52, cathode 53, and separator 56 (schematically shown), all spirally wound in the form of a web around the through hole 11, also referred to as the battery opening. The outer surface of the electric energy source 9 is the protective housing 12. In the battery opening 11 a driving motor 10 extends and is arranged for transmitting drive to a rotary control element 3 for the lock 1' mechanism by means of a gear assembly 6 which includes the at least one gear. The exemplary lock 1' has a body 4, in which the control element 3 is seated rotatably. In some exemplary embodiments, the control element is referred to as a rotatable shaft 30. In the area of the cross-section through the single electric energy source 9 there are at least two points 34 and 36 such that a line segment 32 joining these points passes through the area of the cross-section of the driving motor 10, which is evident, inter alia, in FIG. 3. An exemplary construction of the electric energy source, where anode, cathode and separator are all spirally wound around the through hole is shown in FIG. 3*a*.

Alternative exemplary embodiments include the housing 5 which has the housing interior 64 therein. In such exemplary embodiments the rotatable shaft 30 is in operative connection with the housing 5 and a dog 21 of the lock 1', which will be described in detail later. In such exemplary embodiments, the motor 10 extends in the housing interior 64 and is in operative connection with the shaft 30. The exemplary motor 10 is selectively operative to causes rotation of the shaft 30. Such exemplary embodiments further include the battery cell 9 extending in the housing interior 64 and in at least partially surrounding relation of the motor 10. The exemplary battery cell 9 is in operative electrical connection with motor 10. Further, in such exemplary embodiments, when viewed in cross-section, a line segment 32 between at least two points 34 and 36 on the battery cell 9 passes through at least part of the motor 10. As can be appreciated, these configurations and arrangements are exemplary, and in other embodiments, other configurations and arrangements may be used without departing from the nature of the disclosure herein.

As shown in the exemplary embodiments in FIG. 1, FIG. 2 and FIG. 1*a*, the exemplary driving device 1 is fitted with a base 2 fixed with respect to the lock 1', with the gear assembly 6, electric energy source 9 and driving motor 10 being seated fixedly with respect to the base. In exemplary embodiments, at least one gear of the gear assembly 6 is in operative connection with the motor 10 and the shaft 30. The exemplary at least one gear of the gear assembly 6 is operative to cause rotation of the housing 5 and the shaft 30 during response to operation of the motor 10.

In the exemplary embodiments shown in FIG. 1 and FIG. 1*a*, the exemplary driving device 1 is fitted with a support plate 7 that divides the space inside the housing 5 into a first chamber 22, where the driving motor 10 and the electric energy source 9 are held, and a second chamber 23, where the gear assembly 6 is held.

In the exemplary embodiment shown in FIG. 1*a*, the exemplary control element 3 for the lock 1' mechanism is seated on a toothed wheel 16 being one of the wheels of the gear assembly 6, and the housing 5 is in a form of a rotary bushing seated in a bearing in the base 2 and the housing, from the inner side, has teeth 15 engaging with the toothed wheel 16 of the gear assembly 6, on which the control element 3 for the lock 1' mechanism is seated.

In the exemplary embodiment shown in FIG. 1, the exemplary control element 3 for the lock 1' mechanism is seated on the toothed wheel 16 being one of the wheels of the gear assembly 6, and the housing 5 is in the form of a rotary bushing, in which a ring 17 with teeth 18 is seated, the teeth engaging with the toothed wheel 16 of the gear assembly 6, on which the control element 3 for the lock 1' mechanism is seated.

In the exemplary embodiments shown in FIG. 1 and FIG. 1*a*, the exemplary gear assembly 6 of the driving device 1 comprises a coupling 13, which makes it possible to uncouple the gear 6 connecting the control element 3 to the driving motor 10, with the driving motor 10 being an electric motor. The coupling 13 makes it possible to manually control the lock more easily by rotation of the housing 5, with no resistance from the driving motor 10. In other words, in some exemplary embodiments, the shaft 30 is rotatable without operation of the motor 10 through manual rotation of the housing 5. In such embodiments, the at least one gear 6 is movable between a first position and a second position. In the first position of the at least one gear 6, the at least one gear 6 is operative to transmit rotational motion between the motor and the shaft. In the second position of the at least one gear 6, the at least one gear 6 is not operative to transmit rotational motion between the motor and the shaft.

Figure 4:
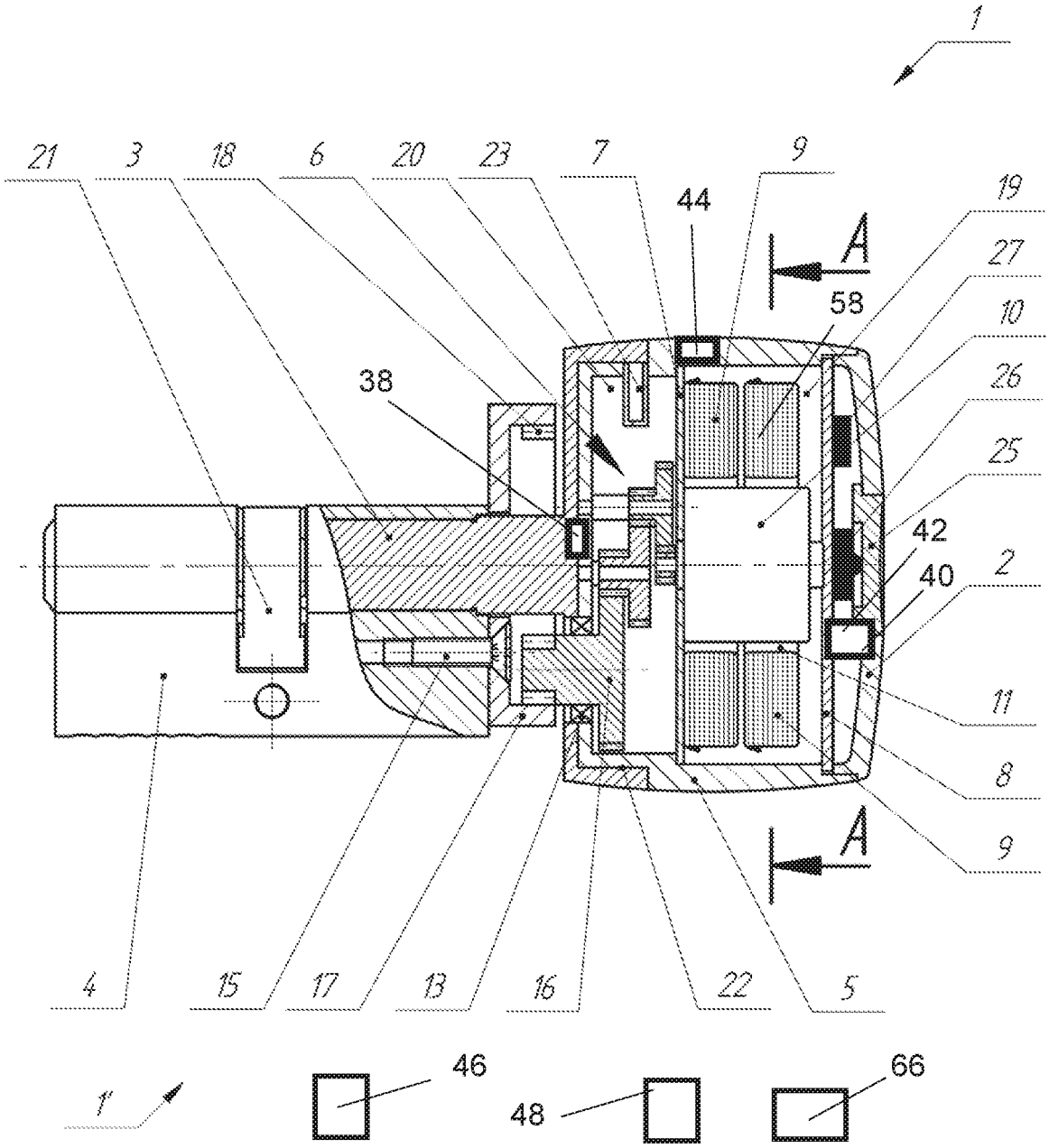
FIG. 4 shows a longitudinal cross-section of an exemplary driving device for unlocking and locking a lock, in an alternative exemplary third embodiment.
Figure 4A:
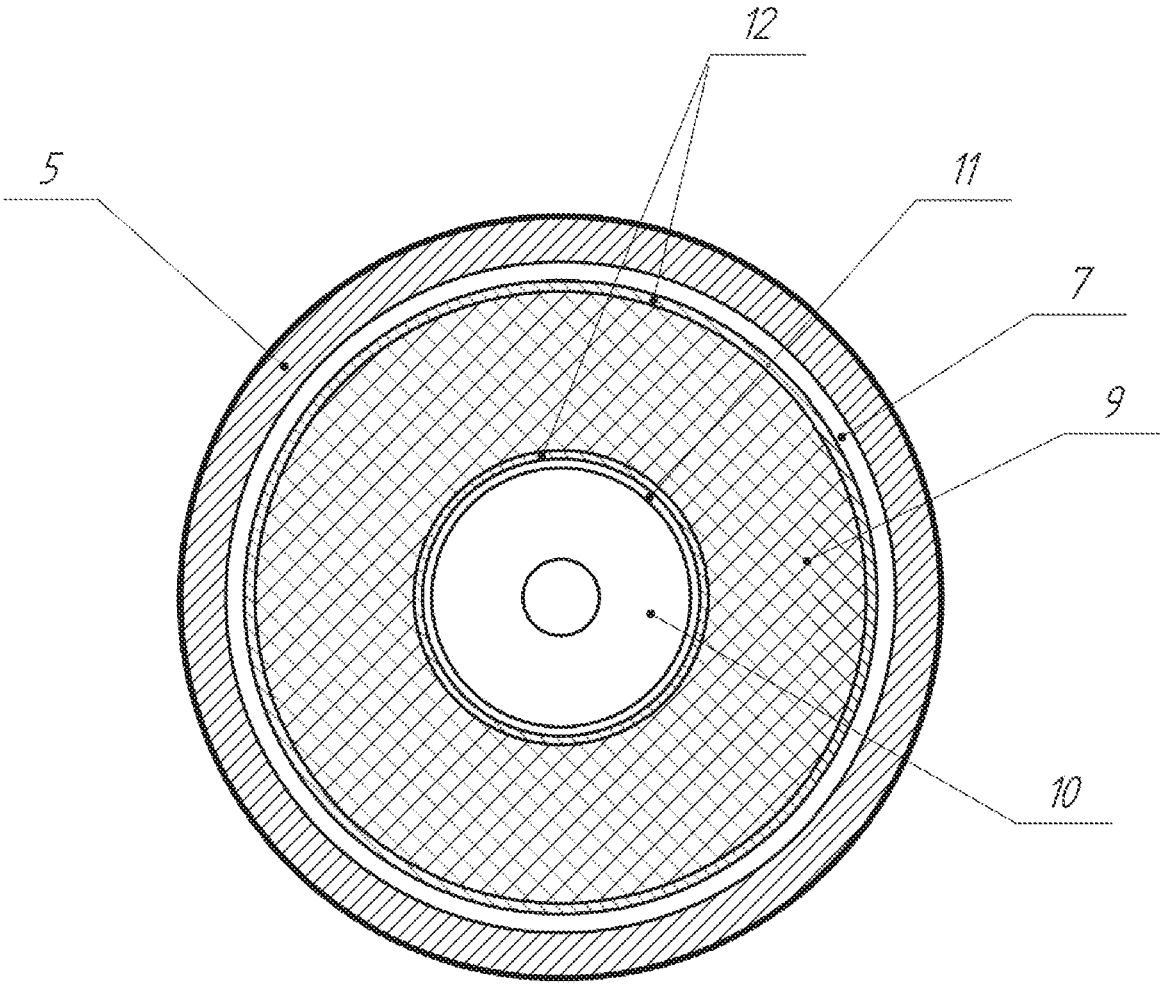
FIG. 4*a* shows an A-A cross section of FIG. 4.
Figure 5:
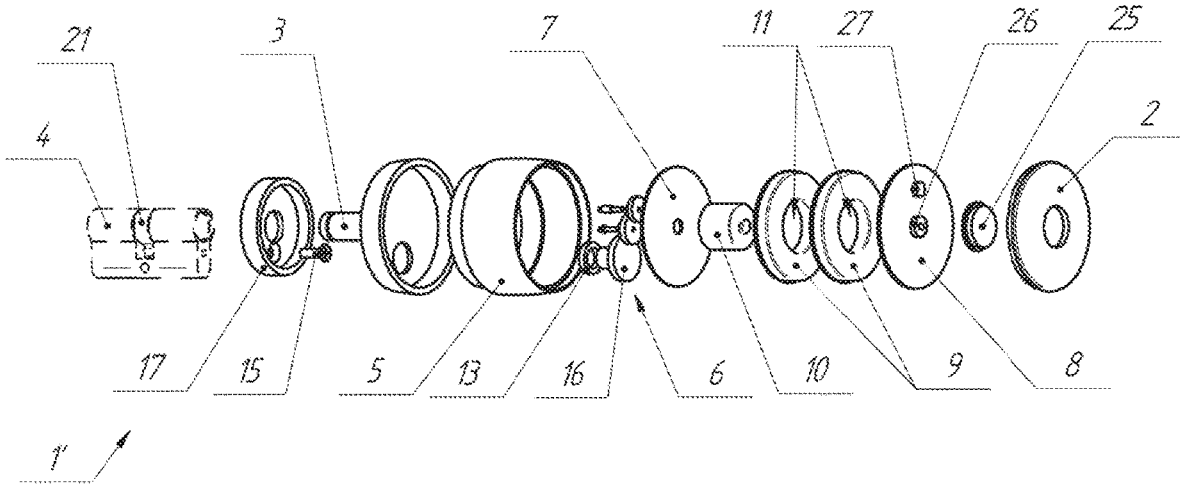
FIG. 5 shows an exploded perspective view of the exemplary driving device of FIG. 4.

The exemplary driving device 1 is fitted with an electronic control unit 8, also referred to as control circuitry, which controls the driving motor 10. The exemplary electronic control unit 8 is controlled wirelessly by means of computer software. Such embodiments further include a transceiver 44, as shown in FIG. 1 and FIG. 4. The transceiver 44 is in operative connection control circuitry 8 and is operative to wirelessly communicate with at least one of a mobile computer 46 or a mobile phone 48. Responsive at least in part to receipt by the transceiver 44 of signals from the mobile computer 46 or the mobile phone 48, the control circuitry 8 is operative to cause operation of the motor 10. In some exemplary embodiments, the control unit 8 is wirelessly controlled by a mobile device application on a mobile computer 46 or a mobile phone 48, via a wireless connection. In alternative exemplary embodiments, the electronic control unit 8 may also be controlled wirelessly via a Bluetooth wireless connection.

As shown in the exemplary embodiments in FIG. 4, FIG. 4*a*, FIG. 5, FIG. 6, FIG. 6*a*, FIG. 7, FIG. 8 and FIG. 8*a*, an exemplary driving device 1 for unlocking and locking a lock 1' enabling access to protected areas is shown and has a housing 5 in a form of a can covered at the front with the frontal part 2. Inside the housing 5 there are two electric energy sources 9, a driving motor 10 and a gear assembly 6. The exemplary driving device 1 is fitted with a support plate 7 dividing the space inside the housing 5 into a first chamber 19, where the driving motor 10 and two electric energy sources 9 are held, and a second chamber 20, where the gear assembly 6 is held. The exemplary driving motor 10 comprises an electric motor. In the bottom of the exemplary housing 5 there is an opening, in which one of toothed wheels 16 of a gear assembly 6 is seated by means of a bearing 13. The exemplary lock 1' has the body 4, in which a control element 3 is seated rotatably for moving a dog 21 of the lock 1'. The control element 3, again also referred to as shaft 30, is in operative connection with the dog 21 such that rotation of the shaft 30 rotationally positions the dog 21 between positions which correspond respectively to a locked condition and an unlocked condition of the lock 1. The exemplary driving motor 10 transmits drive to the control element 3 (shaft 30) for the lock 1' mechanism by means of the gear assembly 6 and a ring 17 with teeth 18. Rotation of the driving motor causes rotation of the housing 5 and control element 3 by the toothed wheel 16 rolling along the ring 17 with the teeth 18. The exemplary electric energy sources 9 are shaped such that they at least partially surround the driving motor 10. The outer surface of the exemplary electric energy source 9 is the protective housing 12. In the area of the cross-section through the single electric energy source 9 there are at least two points 34 and 36 such that a line segment 32 joining these points passes through the area of the cross-section of the driving motor 10, which is evident, inter alia, in FIG. 3.

In the exemplary embodiments shown in FIG. 4, FIG. 4*a*, FIG. 5, FIG. 6, FIG. 6*a*, FIG. 7, FIG. 8 and FIG. 8*a*, alternative exemplary electric energy sources 9 of layered structure are used, where anode, cathode and separator are all arranged in layers, the plane of which is perpendicular to the axis of the driving motor 10.

In the exemplary embodiment shown in FIG. 4, FIG. 4*a*, FIG. 5 and FIG. 10, the exemplary protective housing 12 of the electric energy source 9 has a through hole 11, also referred to as the battery opening, in which the driving motor 10 is arranged. The exemplary protective housing 12 is in surrounding relation of the battery cell 9 and includes the battery opening 11. The exemplary protective housing 12 at least partially bounds the battery opening 11. The exemplary battery opening 11 is cylindrical and extends about an axis 50.

In cross-section, the exemplary protective housing 12 of the electric energy source 9 is wheel-shaped, and the opening 11 is positioned coaxially. In the exemplary embodiment shown in FIG. 6, FIG. 6*a* and FIG. 7, the opening 11 is positioned eccentrically. In the exemplary embodiment shown in FIG. 8, FIG. 8*a*, FIG. 9, the exemplary protective housing 12 of the electric energy source 9 has a cavity 14, in which the driving motor 10 is arranged. The shape of the cavity 14 is cross-sectionally a segment of a wheel.

As shown in the exemplary embodiments in FIG. 4, FIG. 6, FIG. 8 and FIG. 10, the exemplary housing 5 is seated in a bearing rotatably with respect to the body 4 of the lock 1' and is connected fixedly with the control element 3 for the lock 1'. The exemplary driving device 1 is fitted with the ring 17 with teeth 18 cooperating with the toothed wheel 16, being one of the wheels of the gear assembly 6 and seated in a bearing in the housing 5. The exemplary ring 17 is positioned coaxially with the rotary housing 5 and fixedly with respect to the body 4 of the lock 1'. The ring 17 is arranged between the gear assembly 6 and the lock 1'. In the exemplary embodiments shown in FIG. 4, FIG. 6, FIG. 8 and FIG. 10, the exemplary ring 17 is affixed to the lock 1' by means of a screw 15, but it is clear that in other embodiments, the fixed connection of the ring 17 and the lock 1' may be realized with the use of other known methods, for example by means of gluing, riveting or shaping.

Figure 6:
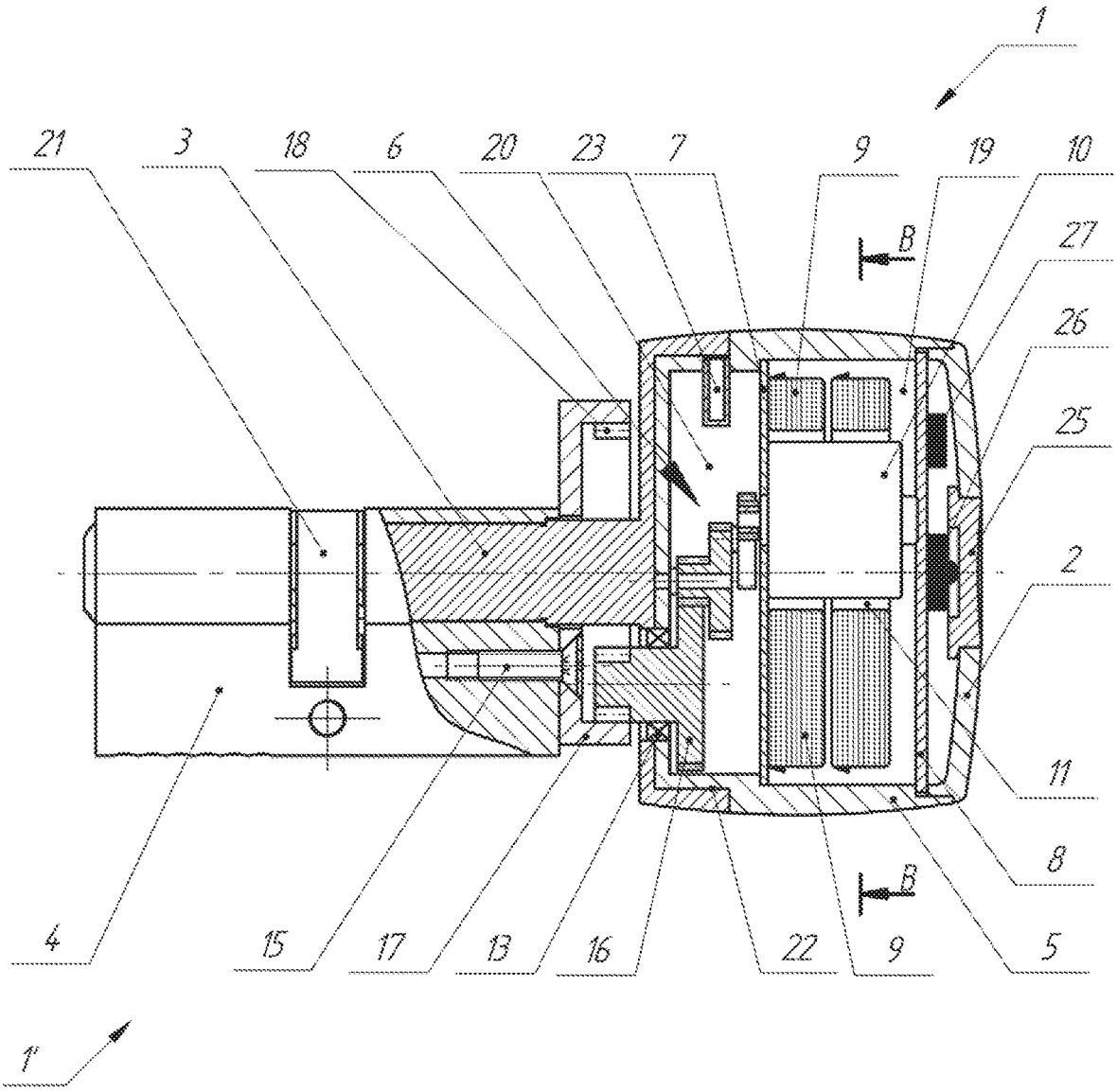
FIG. 6 shows a longitudinal section of an exemplary driving device in an alternative exemplary fourth embodiment.
Figure 6A:
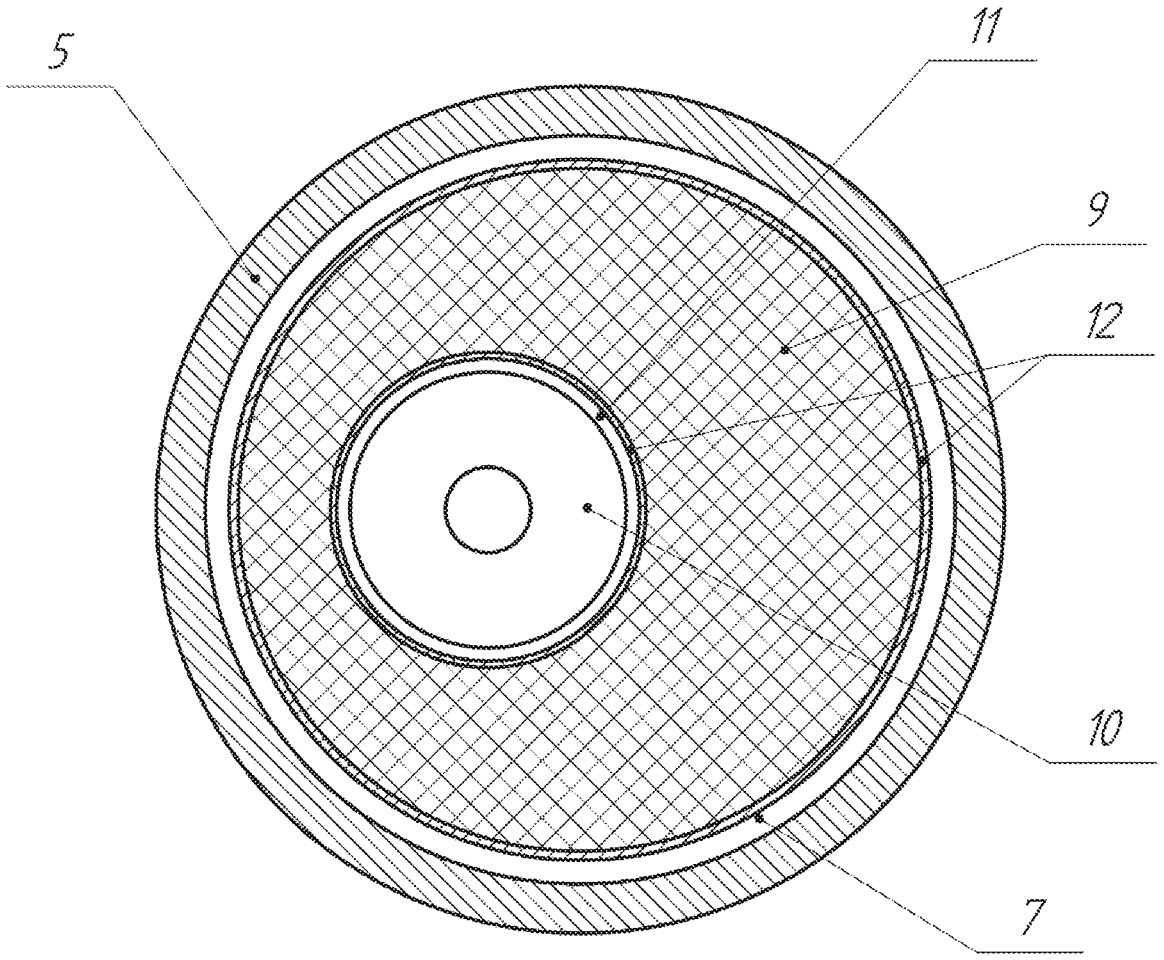
FIG. 6*a* shows a B-B cross section of FIG. 6.
Figure 7:
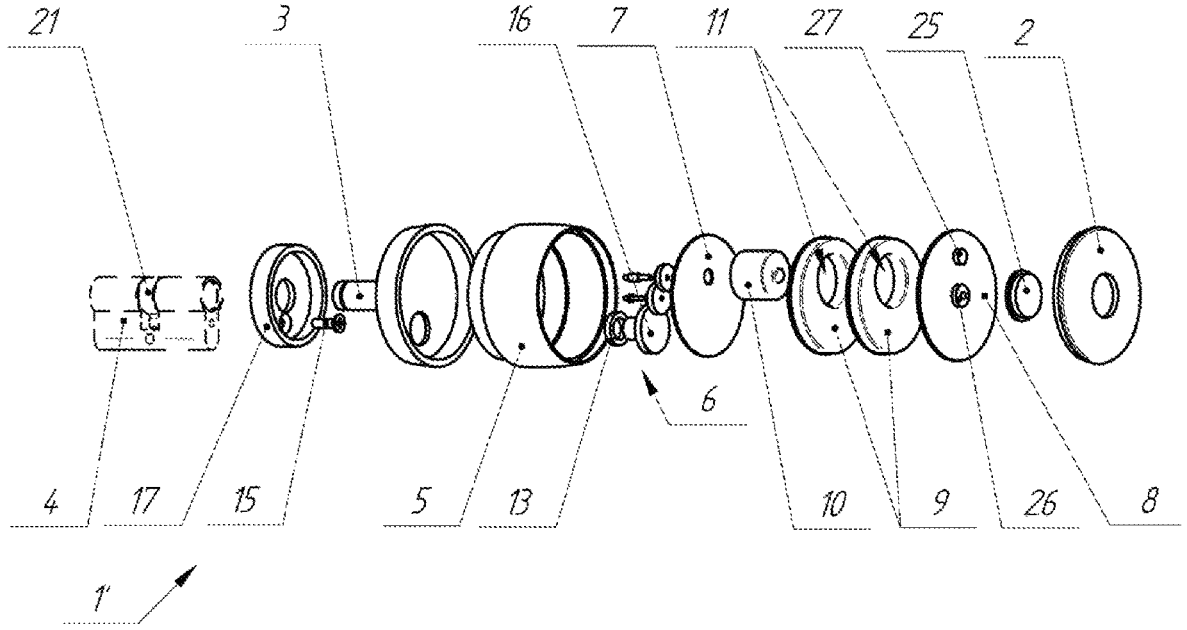
FIG. 7 shows an exploded perspective view of the exemplary driving device of FIG. 6.
Figure 8:
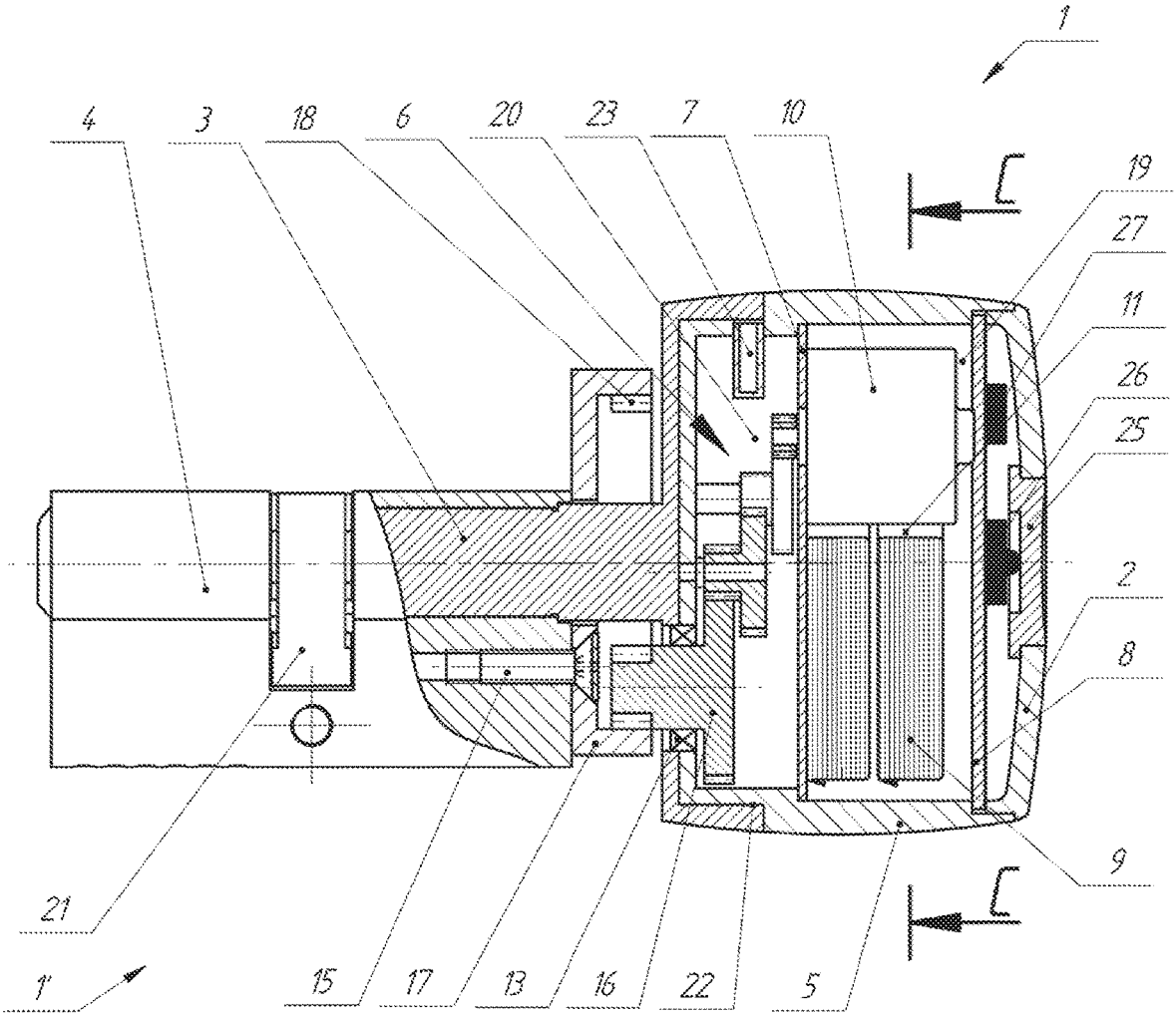
FIG. 8 shows a longitudinal cross-section of the exemplary driving device in an alternative exemplary fifth embodiment.
Figure 8A:
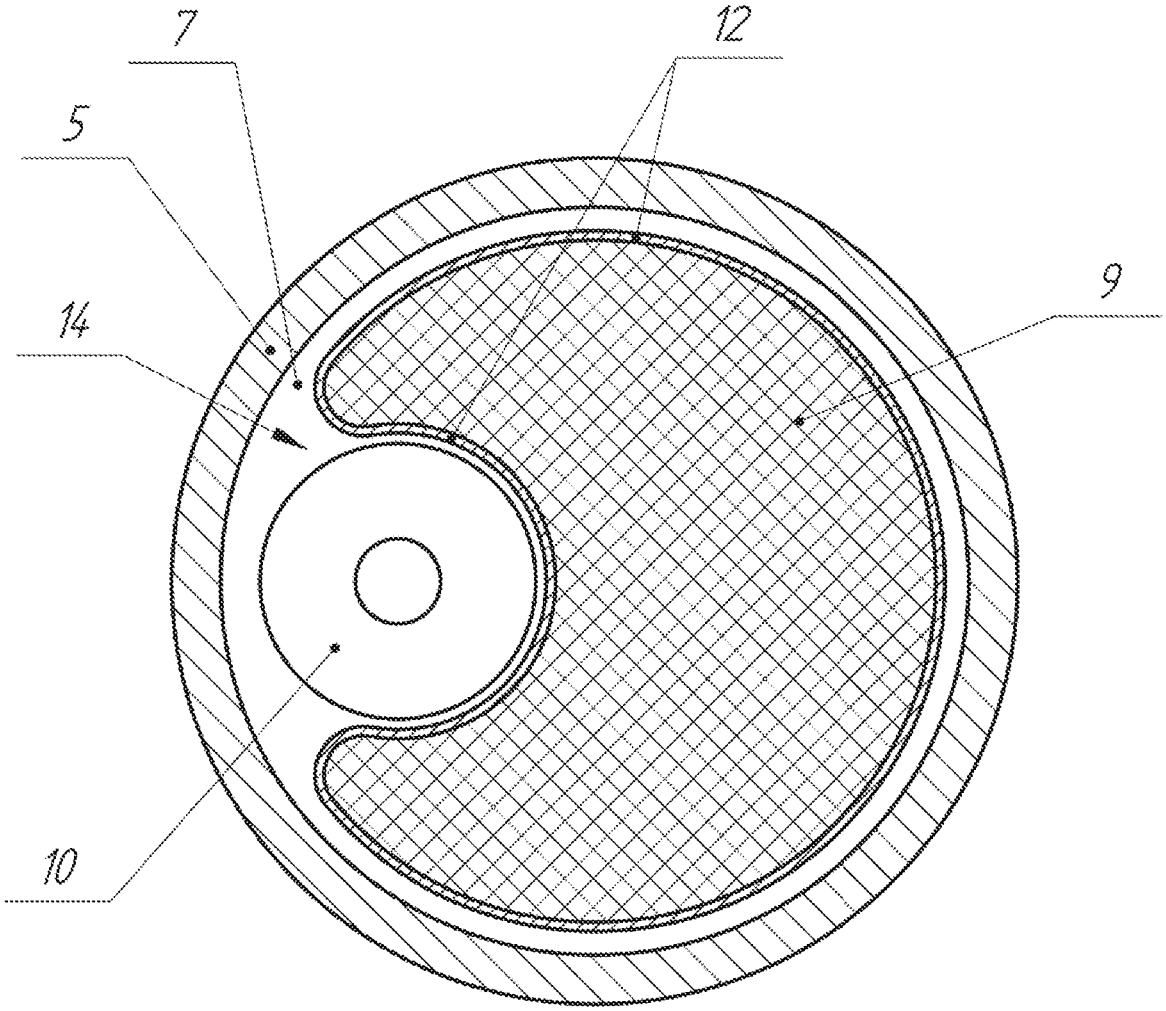
FIG. 8*a* shows a C-C cross-section of FIG. 8.
Figure 9:
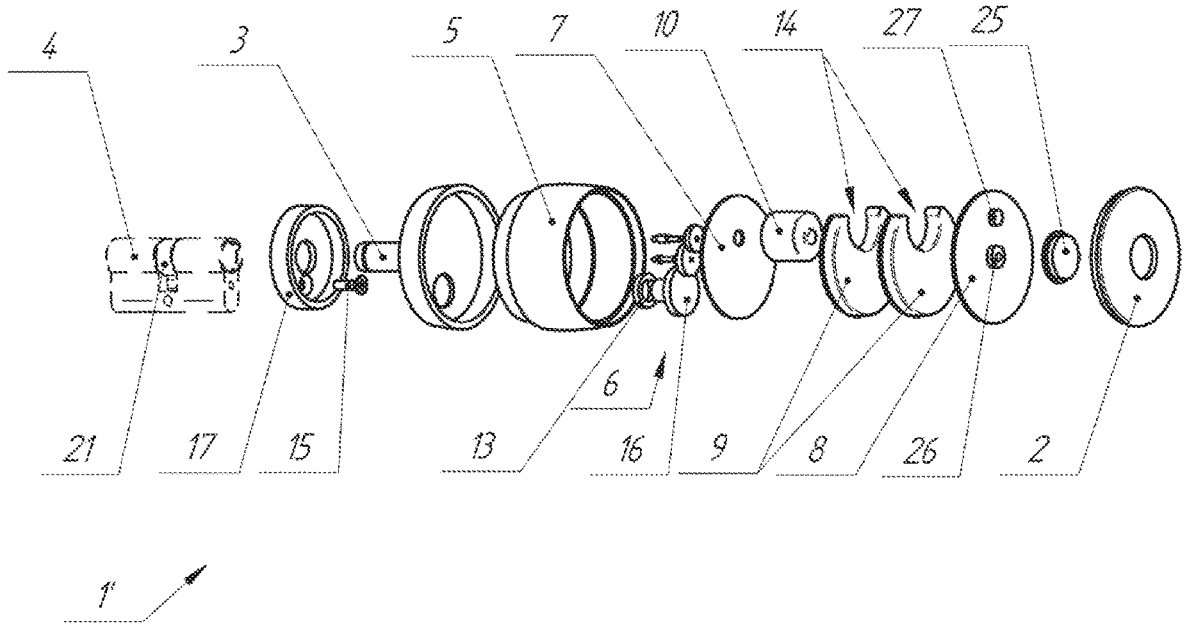
FIG. 9 shows an exploded perspective view of the exemplary driving device of FIG. 8.
Figure 10:
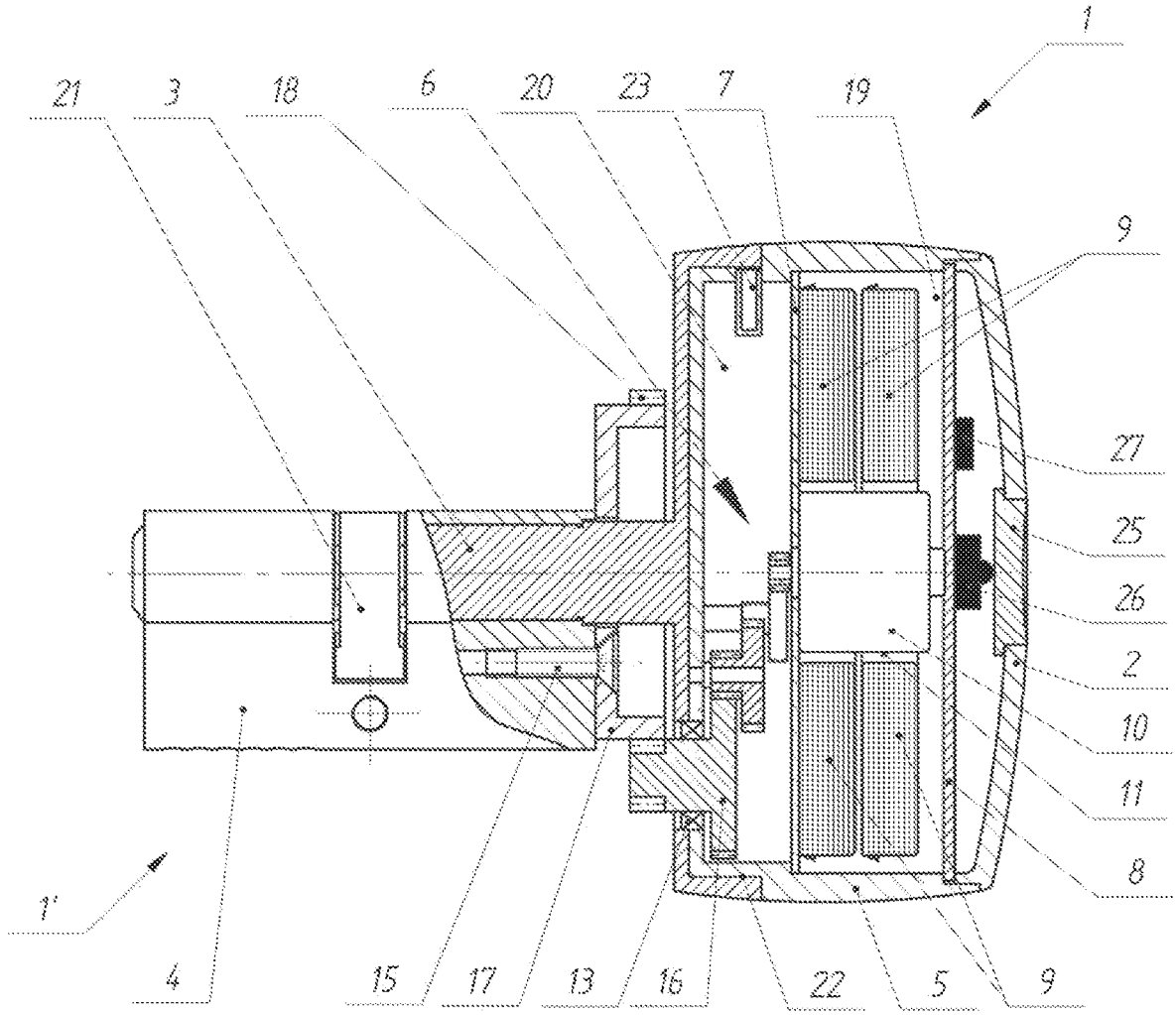
FIG. 10 shows a longitudinal cross-section of the exemplary driving device in an alternative exemplary sixth embodiment.
Figure 11A:
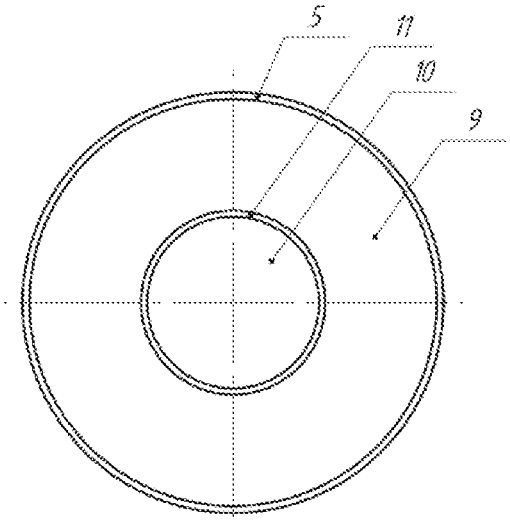
FIG. 11*a* shows an exemplary driving device where the exemplary electric energy source is in a shape of a cylinder with a centrally-positioned opening, as viewed from the front after removing the cover from the housing.
Figure 11B:
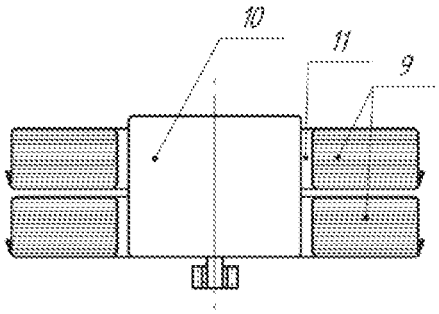
FIG. 11*b* shows a longitudinal cross-section of alternative exemplary two layered flat electric energy sources in a shape of rings surrounding the motor.
Figure 12A:
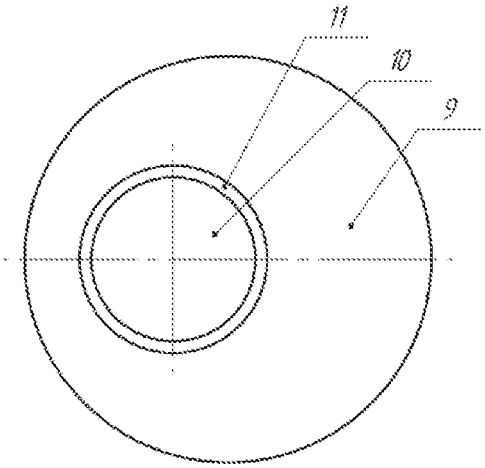
FIG. 12*a* shows an alternative exemplary layered flat electric energy source in a shape of a cylinder with the eccentrically positioned opening, in which the motor is held, in a front view.
Figure 12B:
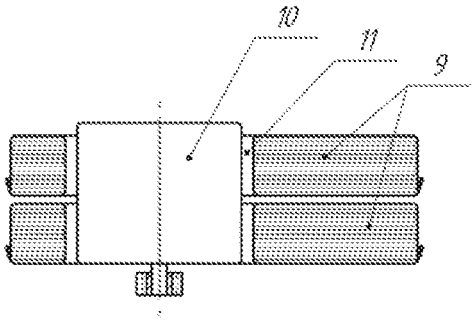
FIG. 12*b* shows a longitudinal section of alternative exemplary two layered flat electric energy sources in a shape of a cylinder and with the eccentrically positioned opening, the electric energy sources surrounding the motor.
Figure 13A:
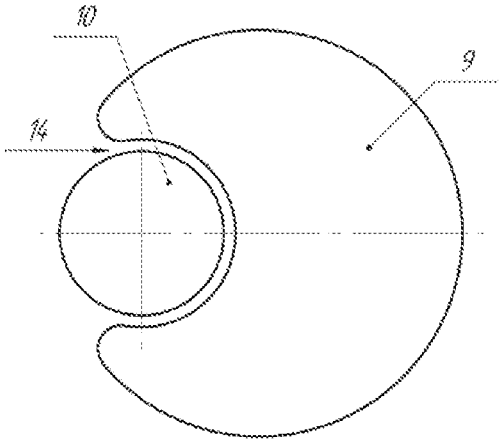
FIG. 13*a* shows an alternative exemplary layered flat electric energy source having a cavity, in which the motor is placed, in a front view.
Figure 13B:
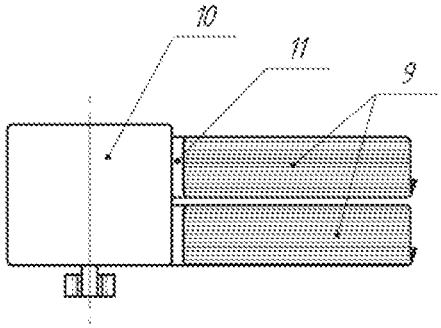
FIG. 13*b* shows a longitudinal section of alternative exemplary two layered flat electric energy sources having a cavity, in which the motor is placed.
Figure 14A:
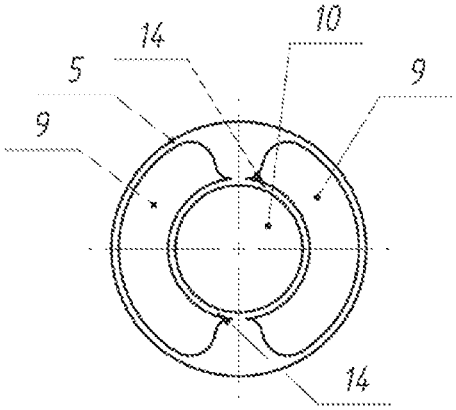
FIG. 14*a* shows alternative exemplary two layered electric energy sources of a shape similar to that of a half-ring, surrounding the driving motor, with layers in a form of sectors of cylindrical surfaces, in a front view.
Figure 14B:
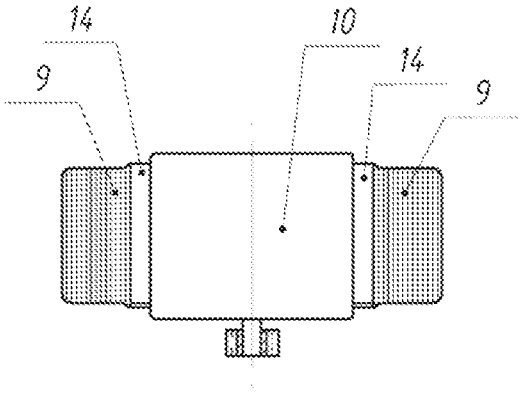
FIG. 14*b* shows a longitudinal section of alternative exemplary two layered electric energy sources of a shape similar to that of a half-ring, surrounding the driving motor, with layers in a form of sectors of cylindrical surfaces.
Figure 15A:
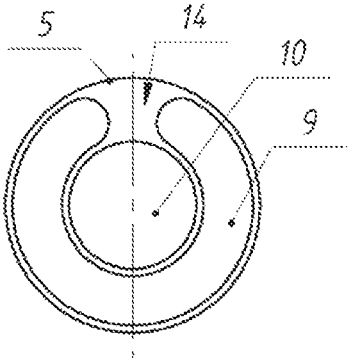
FIG. 15*a* shows an alternative exemplary layered, wound electric energy source in a shape of an open ring, surrounding the driving motor, in a front view.
Figure 15B:
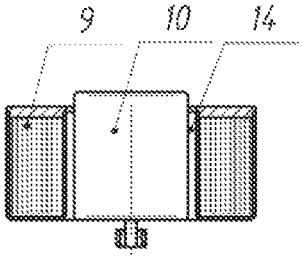
FIG. 15*b* shows an alternative exemplary longitudinal section of a layered, wound electric energy source in a shape of an open ring, surrounding the driving motor.
Figure 15C:
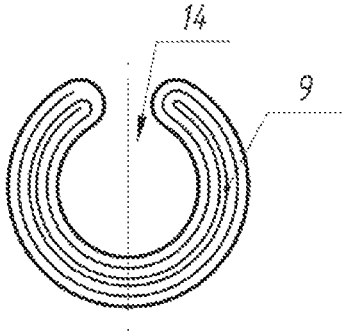
FIG. 15*c* shows a transversal cross section of an alternative exemplary layered, wound electric energy source in a shape of an open ring, with a method for winding layers being shown.
Figure 16A:
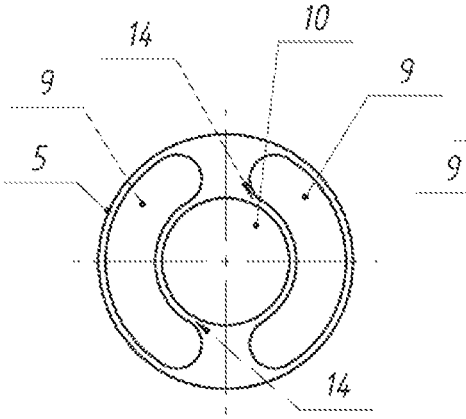
FIG. 16*a* shows alternative exemplary two layered wound electric energy sources of a shape similar to that of a half-ring, surrounding the driving motor, in a front view.
Figure 16B:
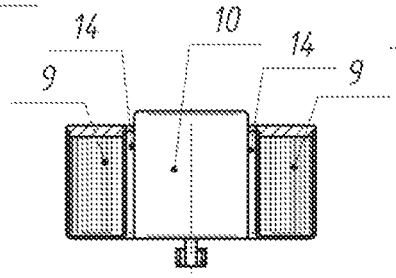
FIG. 16*b* shows a longitudinal cross section of alternative exemplary two layered wound electric energy sources of a shape similar to that of a half-ring, surrounding a driving motor.
Figure 16C:
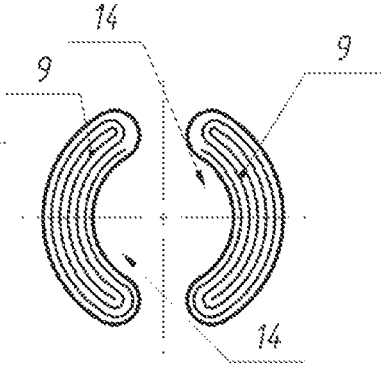
FIG. 16*c* shows a cross-section of alternative exemplary two layered wound electric energy sources of a shape similar to that of a half-ring, with a method for winding layers being shown.

As shown in the exemplary embodiments in FIG. 4, FIG. 6 and FIG. 8, the exemplary teeth 18 of the ring 17 are inner teeth, whereas in the alternative exemplary embodiment shown in FIG. 10, the teeth 18 of the ring 17 are outer teeth.

As shown in the exemplary embodiments in FIG. 4, FIG. 6, FIG. 8 and FIG. 10, the exemplary driving device 1 is fitted with an electronic control unit 8, also referred to as control circuitry, which controls the driving motor 10. The control circuitry 8 is in operative connection with the motor 10 and is operative to selectively operate the motor 10 to cause rotation of the shaft 30. The exemplary electronic control unit 8 is held between the driving motor 10 and the frontal part 2 of the housing 5. The exemplary electronic control unit 8 is fitted with a first sensor 26 cooperating with a manual control button 25 arranged on the frontal part 2 of the driving device 1. In exemplary embodiments, the manual control button 25 is in operative supported connection with the housing 5, as shown in FIG. 4. The exemplary control button 25 is configured to be manually operable. The exemplary control button 5 is in electrical connection with the control circuitry 8. In exemplary embodiments, the manual operation of the control button 5 causes the control circuitry 8 to cause operation of the motor 10.

The electronic control unit 8 is fitted with at least one sensor 38. The at least one sensor 38 includes a second sensor 27, which establishes angular position of the rotary housing 5. In some exemplary embodiments, the second sensor 27 is an accelerometer (a sensor establishing a parameter corresponding to an angular position of the rotary housing 5 with respect to the gravity field of the Earth), which parameter is usable by the control circuitry to determine the rotational position of the shaft. Alternative exemplary embodiments include at least one sensor 38 that is operative to sense at least one parameter corresponding to a rotational position of the shaft. The exemplary at least one sensor 38 is usable to sense if the lock is in the locked condition or the unlocked condition. In alternative exemplary embodiments, the at least one sensor 38 may be in operative connection with the housing 5 and is operative to sense a parameter corresponding to a rotational orientation of the housing.

In exemplary embodiments, the control circuity 8 is in operative connection with the motor 10 and is operative to selectively operate the motor 10 to cause rotation of the shaft 30. In alternative exemplary embodiments, the at least one sensor 38 is in operative connection with the motor control circuitry. In such embodiments, the control circuitry is operative to selectively operate the motor to cause rotation of the shaft to change the lock between the locked condition in the unlocked condition responsive at least in part to the at least one parameter.

In alternative exemplary embodiments the at least one sensor 38 is operative to sense a rotational position of at least one of the shaft 30 and the housing 5. In such embodiments, the control circuitry 8 is operative responsive at least in part to the sensed rotational position to make a determination that the lock 1' is in one of the locked condition or the unlocked condition. Further, the control circuitry 8 is operative responsive at least in part to the determination to cause the motor 10 to rotate the shaft 30 to cause the lock 1' to be in the other of the locked or unlocked condition.

As shown in the exemplary embodiments in FIG. 4, FIG. 6, FIG. 8 and FIG. 10, the exemplary housing 5 is connected to the control element 3 by means of a shaped releasable connection 22. The housing 5 is fitted with an electric socket 40 accessible after disconnection of the shaped releasable connection 22 and invisible in the connected position. In alternative exemplary embodiments, the electrical socket 40, in any position, is configured to be operatively connected to an electrical power source to permit the electrical socket 40 to be usable to charge the battery cell 9. In some exemplary embodiments, the electric socket 40 is a micro USB type port 42 configured to deliver supply voltage, charge the electric energy source 9 and transfer data. The shaped releasable connection of the housing 5 and the control element 3 may of course be realised by other known methods.

In all exemplary embodiments shown in FIG. 1-FIG. 19*b*, the exemplary electric energy source 9 is so shaped that it at least partially surrounds the driving motor 10, and in the area of cross-section through an individual electric energy source 9 there are at least two points such that a line segment joining these points passes through the area of cross-section of the driving motor 10.

In the exemplary embodiments shown in FIG. 1, FIG. 1*a*, FIG. 2 and FIG. 3, FIG. 3*a*, FIG. 4, FIG. 4*a*, FIG. 5, FIG. 11*a* and FIG. 11*b*, FIG. 17*a*, FIG. 17*b*, the exemplary electric energy source 9 (battery cell 9) is in the shape of a cylinder with a wheel-shaped opening 11, positioned coaxially, and in the exemplary embodiment shown in FIG. 6, FIG. 6*a* and FIG. 7, FIG. 12*a*, FIG. 12*b*, the exemplary opening 11 is positioned eccentrically. Inside the battery opening 11 there is the driving motor 10.

In the exemplary embodiments shown in FIG. 8, FIG. 8*a*, FIG. 9, FIG. 13*a*, FIG. 13*b*, FIG. 14*a*, FIG. 14*b*, FIG. 15*a*, FIG. 15*b*, FIG. 15*c*, FIG. 16*a*, FIG. 16*b*, FIG. 16*c*, FIG. 18*a*, FIG. 18*b*, FIG. 19*a*, FIG. 19*b*, the exemplary electric energy source 9 (battery cell 9) has a cavity 14, in which the driving motor 10 is arranged. The shape of the cavity 14 in cross-section is a segment of a wheel. In the exemplary embodiments shown in FIG. 14*a*, FIG. 14*b*, FIG. 15*a*, FIG. 15*b*, FIG. 16*a*, FIG. 16*b*, FIG. 18*a*, FIG. 18*b*, FIG. 19*a*, FIG. 19*b*, the exemplary protective housing 12 of the electric energy source 9 is a segment of a ring, the axis of whose is parallel to the axis of the driving motor 10.

Some exemplary embodiments include a further battery cell 58 (see FIG. 4). The exemplary further battery cell 58 is aligned in axially disposed relation of the battery cell 9, about an axis 50 of the battery opening, the axis 50 is best shown in FIG. 3. In the exemplary embodiments shown in FIG. 14*a*, FIG. 14*b*, FIG. 16*a*, FIG. 16*b*, FIG. 16*c*, FIG. 18*a* and FIG. 18*b*, there is shown an exemplary alternative embodiment with two electric energy sources 9 (battery cell 9 and further battery cell 58) in a shape being a segment of a ring, and in the exemplary embodiment shown in FIG. 19*a* and FIG. 19*b*, there is shown an exemplary embodiment with four such electric energy sources 9.

Figure 17A:
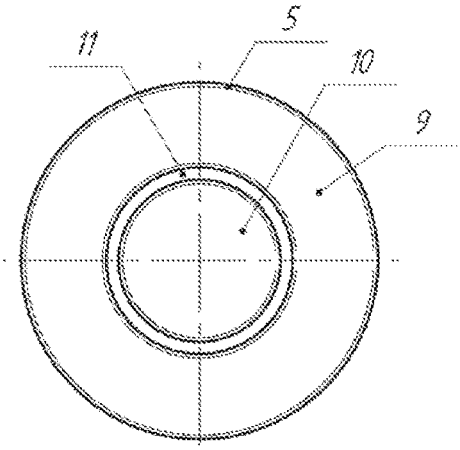
FIG. 17*a* shows an exemplary driving device when an alternative exemplary electric energy source is in a shape of a cylinder with a centrally-positioned opening, in a front view after removing the frontal part from the housing.
Figure 17B:
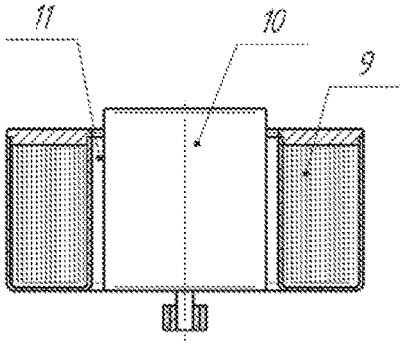
FIG. 17*b* shows a longitudinal section of an alternative exemplary electric energy source in a form of a ring, whose layers are wound spirally in the form of a web around the central opening where the driving motor is placed.
Figure 18A:
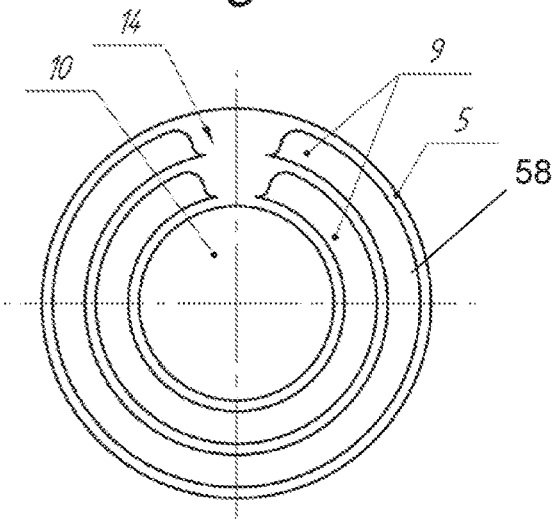
FIG. 18*a* shows alternative exemplary two layered electric energy sources in a shape of an open ring, surrounding a motor, whose layers are in a form of sectors of cylindrical surfaces, in a front view.
Figure 18B:
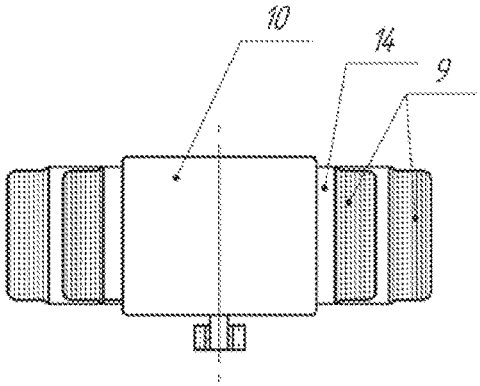
FIG. 18*b* shows a longitudinal section of alternative exemplary two layered electric energy sources in a shape of an open ring, surrounding a motor, with layers in a form of sectors of cylindrical surfaces.
Figure 19A:
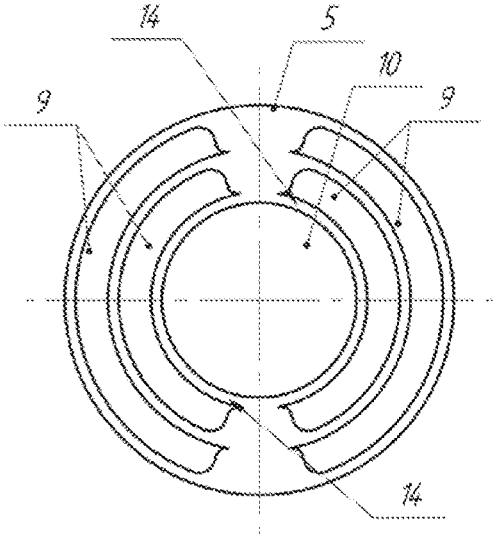
FIG. 19*a* shows alternative exemplary four layered electric energy sources in a shape of a ring segment, surrounding a driving motor, with layers in a form of sectors of cylindrical surfaces, in a front view.
Figure 19B:
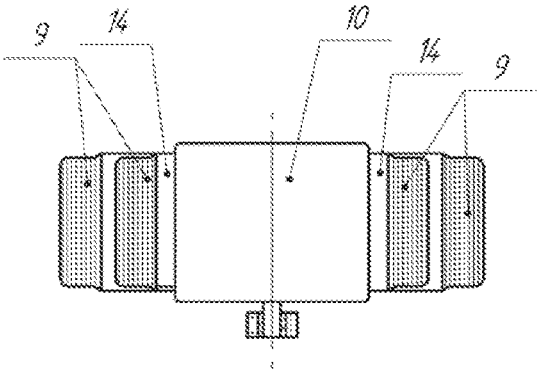
FIG. 19*b* shows a longitudinal cross section of alternative exemplary four layered electric energy sources in a shape of a ring segment, surrounding a driving motor, with layers in a form of sectors of cylindrical surfaces.

As shown in FIG. 3*a*, FIG. 17*a*, FIG. 17*b*, the exemplary electric energy source 9 is fitted with an anode 9*a*, cathode 9*c* and separator 9*b*, all spirally wound in a form of a web around the through hole 11.

In the exemplary embodiments shown in FIG. 14*a*, FIG. 14*b*, FIG. 18*a*, FIG. 18*b*, FIG. 19*a* and FIG. 19*b*, the exemplary electric energy source 9 is fitted with the anode 9*a*, cathode 9*c* and separator 9*b*, all arranged in layers being sectors of cylindrical surfaces of an axis parallel to the axis of the driving motor 10. And in the exemplary embodiments shown in FIG. 15*a*, FIG. 15*b*, FIG. 15*c*, FIG. 16*a*, FIG. 16*b*, FIG. 16*c*, the exemplary electric energy source 9 is fitted with an anode, cathode and separator all spirally wound and shaped in the form of an open ring, as in FIG. 15*a*, FIG. 15*b*, FIG. 15*c* or ring segments, as in FIG. 16*a*, FIG. 16*b*, FIG. 16*c*.

It is clear that the electric energy source 9 may also have other forms not shown in the drawings, the forms fulfilling the requirements that the electric energy source 9 is so shaped that it at least partially surrounds the driving motor 10. The energy source 9 being so shaped and arranged with respect to the driving motor 10 enables essential reduction of the overall dimensions of the driving device 1.

In some exemplary embodiments, the electric energy source 9 is a primary or secondary electric cell.

In some exemplary embodiments, the driving device 1 is arranged at the inner side (not shown) of an entrance to access-protected areas and on the opposite side to the key-controlled part of the lock 1'.

Thus, the elements, features, and characteristics of the exemplary embodiments described achieve desirable results, eliminate difficulties encountered in the use of the prior art devices and systems, solve problems, and attain one or more useful objectives as described herein.

In the foregoing description, certain terms have been used for brevity, clarity, and understanding. However, no unnecessary limitations are to be implied therefrom because such terms are used for descriptive purposes and are intended to be broadly construed. Moreover, the descriptions and illustrations given herein are by way of examples and the useful features are not limited to the exact details shown and described.

Further, in the description, words that refer to left/right, top/bottom, up/down or similar terms indicating relative locations of items shall not be deemed limiting and it is to be understood that exemplary embodiments can be configured and used in numerous different orientations.

Having described the features, discoveries, and principles of the exemplary embodiments, the manner in which they are constructed, operated and utilized, and the advantages and useful results attained, the new and useful structures, devices, elements, arrangements, parts, combinations, systems, equipment, operations, methods, processes and relationships are set forth in the appended claims.

The invention claimed is:

1. Apparatus operative to selectively rotationally position a dog of a lock, wherein rotationally positioning the dog is operative to change the lock between a locked condition and an unlocked condition, comprising:

a housing, wherein the housing includes a housing interior, a rotatable shaft, wherein the shaft is in operative connection with the housing, and wherein the shaft is in rotational connection with the dog, a motor, wherein the motor extends in the housing interior and is in operative connection with the shaft, and wherein the motor is selectively operative to cause rotation of the shaft, a battery cell, wherein the battery cell extends in the housing in at least partially surrounding relation of the motor and is in operative electrical connection with the motor, wherein in cross-section, a line segment between at least two points on the battery cell passes through at least part of the motor.

2. The apparatus according to claim 1 wherein the shaft is rotatable without operation of the motor through manual rotation of the housing.

3. The apparatus according to claim 2 and further comprising:

at least one sensor, wherein the at least one sensor is operative to sense at least one parameter corresponding to a rotational position of the shaft, and wherein the at least one sensor is usable to sense if the lock is in the locked condition or the unlocked condition.

4. The apparatus according to claim 3
wherein the at least one sensor is in operative connection with the housing, wherein the at least one parameter includes a rotational orientation of the housing.

5. The apparatus according to claim 3
and further comprising:
control circuitry, wherein the control circuitry is in operative connection with the motor, and wherein the control circuitry is operative to selectively operate the motor to cause rotation of the shaft.

6. The apparatus according to claim 5
wherein the at least one sensor is in operative connection with the control circuitry, wherein responsive at least in part to the at least one parameter, the control circuitry is operative to selectively operate the motor to cause rotation of the shaft to change the lock between the locked and unlocked conditions.

7. The apparatus according to claim 6 and further comprising:
a manual control button, wherein the control button is
in operative supported connection with the housing,
is configured to be manually operable,
is in electrical connection with the control circuitry, and
is operative to cause the control circuitry to cause operation of the motor.

8. The apparatus according to claim 7
wherein the housing includes an electric socket, wherein the electric socket is configured to be operatively connected to an electric power source, wherein the electric socket is usable to charge the battery cell.

9. The apparatus according to claim 8
wherein the electric socket comprises a USB port.

10. The apparatus according to claim 8
and further comprising:
a transceiver, wherein the transceiver is in operative connection with the control circuitry, wherein the transceiver is operative to wirelessly communicate with at least one of
a mobile computer, or
a mobile phone,
wherein the control circuitry is operative to cause operation of the motor responsive at least in part to receipt by the transceiver of signals from the at least one mobile computer or mobile phone.

11. The apparatus according to claim 10
wherein the battery cell includes a protective housing, wherein the protective housing is in surrounding relation of the battery cell, wherein the protective housing includes a battery opening, wherein the protective housing at least partially bounds the battery opening,
wherein the battery opening is cylindrical and extends about an axis,
wherein the motor extends in the battery opening.

12. The apparatus according to claim 11
wherein the protective housing is wheel shaped, wherein the battery opening is positioned
internally of the wheel shaped protective housing and is arranged either
coaxially, or
eccentrically
of the wheel shaped protective housing.

13. The apparatus according to claim 12
wherein the protective housing bounds only part of the battery opening.

14. The apparatus according to claim 12
wherein the battery cell includes an anode, a cathode, and a separator, wherein the anode, the cathode, and the separator are either
spirally wound around the battery opening, or
arranged in layers that extend transversely of the axis and around the battery opening.

15. The apparatus according to claim 14
and further comprising:
a further battery cell, wherein the further battery cell is aligned in axially disposed relation of the battery cell.

16. The apparatus according to claim 15
and further comprising:
at least one gear,
wherein the at least one gear is in operative connection with the motor and the shaft, and wherein operation of the motor is operative to cause rotation of the housing, the at least one gear, and the shaft.

17. The apparatus according to claim 16
wherein the at least one gear is movable between a first position and a second position,
wherein in the first position, the at least one gear is operative to transmit rotational motion between the motor and the shaft,
wherein in the second position, the at least one gear is not operative to transmit rotational motion between the motor and the shaft.

18. Apparatus operative to change a lock between a locked condition
and an unlocked condition, comprising:
a housing, wherein the housing includes a housing interior,
a rotatable shaft, wherein the shaft is in operative connection with the housing,
wherein the shaft is configured to be in operative connection with the lock, wherein the shaft is rotatable to change the lock between the locked condition and the unlocked condition,
a motor, wherein the motor extends in the housing interior,
wherein the motor is in operative connection with the shaft,
a battery cell, wherein the battery cell
extends in the housing interior,
extends in at least partially surrounding relation of the motor,
is in operative electrical connection with the motor,
wherein in cross-section, a line segment between at least two points on the battery cell passes through at least part of the motor.

19. The apparatus according to claim 18
wherein the shaft is rotatable without operation of the motor through manual rotation of the housing.

20. The apparatus according to claim 19
and further comprising:
control circuitry, wherein the control circuitry is in operative connection with the motor, and wherein the control circuitry is operative to selectively operate the motor to cause rotation of the shaft,
at least one sensor, wherein the at least one sensor is in operative connection with the control circuitry,
wherein the at least one sensor is operative to sense a rotational position of
at least one of
the shaft, and
the housing, wherein the control circuitry is operative responsive at least in part to the sensed rotational position to make a determination that the lock is in one of the locked condition or the unlocked condition, wherein the control circuitry is operative responsive at least in part to the determination to cause the motor to rotate the shaft to cause the lock to be in the other of the locked or unlocked condition.

21. The apparatus according to claim 20 and further comprising:

a transceiver, wherein the transceiver is in operative connection with the control circuitry, wherein the transceiver is configured to wirelessly communicate with a mobile wireless device, wherein the control circuitry is operative to cause operation of the motor responsive at least in part to receipt by the transceiver of signals from the mobile wireless device.

* * * * *